United States Patent [19]

Bloeck et al.

[11] 4,253,584

[45] Mar. 3, 1981

[54] RING AND CLOSURE FOR CANS

[75] Inventors: Siegfried Bloeck, Singen, Fed. Rep. of Germany; Rudolf Lüthi, Niederwangen, Switzerland

[73] Assignee: Swiss Aluminium Ltd., Chippis, Switzerland

[21] Appl. No.: 40,499

[22] Filed: May 21, 1979

[30] Foreign Application Priority Data

Jun. 6, 1978 [CH] Switzerland ..... 6197/78

[51] Int. Cl.[3] ..... B65D 41/00

[52] U.S. Cl. ..... 220/359; 220/265; 229/43

[58] Field of Search ..... 220/66, 67, 260, 265, 220/359, 252; 229/43; 113/121 A, 121 R

[56] References Cited

U.S. PATENT DOCUMENTS

| | | | |
|---|---|---|---|
| 3,274,964 | 9/1966 | Griese, Jr. | 229/43 UX |
| 3,547,305 | 12/1970 | Khoury | 220/359 |
| 4,090,004 | 5/1978 | Tebbutt et al. | 220/359 X |

*Primary Examiner*—George T. Hall

*Attorney, Agent, or Firm*—Bachman and LaPointe

[57] ABSTRACT

The process of the present invention allows the manufacture of lacquered aluminum or tin-plate rings which have the inner edge thereof bent over outwards so that they are suitable for the closures on cans for foodstuffs. A ring blank made of lacquered sheet is pre-shaped by deep drawing to form the curvature needed for bending over the inner cut edge. The final shaping of the pre-shaped blank into a ring for a can lid takes place, after stamping out the opening, by stretching and bending over the cut edge. When a tear-back membrane is sealed on to the bent-over edge, the ring is suitable as an easyly opened closure for cans for foodstuffs.

14 Claims, 7 Drawing Figures

RING AND CLOSURE FOR CANS

BACKGROUND OF THE INVENTION

The present invention resides in a process for manufacturing lacquered rings of aluminum or tin-plate for use as lids on food cans wherein the inner cut edge is turned over outwards.

Today, cans represent favorably priced containers which can withstand knocks and heavy handling. In addition, cans can be used to hold a large variety of foodstuffs. Various opening systems have been developed so as to enable the customer to open the cans without the need of any special tools.

For example, there are lids made of aluminum or tin-plate which can be torn open along a line of weakness by means of a flap or a ring secured to a hollow rivet shaped out of the lid. Such lids, which can also withstand sterilization treatment, lead to the exposure of sharp, cut edges which represent a considerable hazard to the user. Furthermore, if the indentation forming the line of weakness is insufficient, the opening of the can is possible only by applying excessive force. On the other hand, if the indentation is too deep, then there is a danger of the lid being penetrated accidentally. A lid with a line of weakness is more sensitive to knocks which could cause the can to burst open. Another disadvantage which must be taken into account is that failure of the material can occur due to corrosion at the line of weakness caused by an agressive content. Such corrosive attack is known to occur preferentially in those regions where the material has been heavily deformed.

There are other known can lids which comprise a ring having a tearback membrane made of aluminum sealed to it. To reduce the risk of injury, the sharp edge on the opening in the ring, which results from the manufacture of the ring, is bent over inwards. Such lids have proved useful for cans containing dry substances. However, when the contents contain water and in particular when the contents is aggressive, these lids are not suitable, as the cut edge which is turned inwards is in contact with the contents. Consequently, in particular during the sterilization process, the cut edge is exposed to corrosive attack which causes contamination of the contents and reduces their value. Today it is not technically possible to subsequently apply a perfect lacquer coating to the cut edge. Furthermore, for economic reasons, it would not be justifiable. In addition, lacquering the cut edge would not reduce the risk of injury to the user on removing the contents from the can. In addition to the foregoing, there are light weight containers which are corrosion resistant, able to withstand sterilization and easy to open. These containers are made of aluminum coated in plastic and are closed via a sealed seam. The main disadvantage of these containers is their lack of rigidity.

SUMMARY OF THE INVENTION

The easily opened containers representing the state of the art today as outlined above exhibit, besides their specific advantages, significant disadvantages. It is the object of the present invention to provide favorably priced, easily opened container which, after opening, does not exhibit sharp edges which represent a risk of injury, can be sterilized, is corrosion resistant towards aggressive contents and is, to a large degree, resistant to mechanical damage can be met with a can having an opening system comprising an aluminum tear-back membrane sealed to a ring for the lid. The cut edge of the ring produced during the manufacture of the ring and delimiting the size of opening of the can must be turned outwards and the tear-back membrane sealed to the edge which has been folded over.

In principle it is possible after punching out the opening to turn the cut edge outwards by bending it upwards and folding it over. However it turns out that this calls for a very small radius of curvature because the process involves drawing the metal i.e. deformation as a result of elongation of the metal. Because the radius of curvature is small, the lacquer coating is damaged in the area which is sharply bent over. If the radius of curvature is increased the elongation properties of the metal are insufficient to prevent tearing of the cut edge during the large increase in diameter which occurs during bending over.

The present invention provides a process for manufacturing lacquered rings for can lids of aluminum or tin-plate in which the inner cut edge is turned outwards and is suitable for sealing on an aluminum membrane which can be pulled off.

The objects of the present invention are attained by providing a blank for a lid ring which is produced from a lacquered sheet and is preformed by deep drawing to form the required curvature for folding over of the inner cut edge. The final shaping of the ring takes place after punching out the opening by stretching and turning over the cut edge.

The use of deep drawing for the production of the blank in present the invention makes it possible to manufacture a ring for can lids with the cut edge turned out without causing the sheet or the stove lacquered coating to tear during the shaping operation. The reason for this is that on deep drawing the material is drawn from the outer part to the deformation zone and therefore is required to stretch only slightly.

It is desired that the radius of curvature lies between 0.6 and 1.0 mm, preferably at approximately 0.8 mm.

According to an advantageous method of carrying out the process of the present invention, the final shaping of the curvature required for the folding over of the cut edge does not take place until the opening has been punched out.

Because the ring is used for lids of cans for foodstuffs it is preferred that the lacquer be made of a phenolic, epoxy or phenolic-epoxy resin.

When manufacturing can lids with aluminum tear-back membranes which are easy to open and able to withstand sterilizing it is preferred that the lacquer can be sealed to polyamides.

In the case of the ring made in accordance with the process of the present invention, a lid in the form of a tear-back membrane made of lacquered aluminum thin strip coated with polyamide can be sealed onto the edge which has been folded back.

An embodiment which is able to withstand sterilization particularly well is obtained if the lacquer on the thin strip is made of phenolic epoxy resin and coated with polyamide 12.

Such an embodiment is particularly suitable as a sterilizible closure for cans for foodstuffs.

It has also been found to be advantageous if the lacquer is made up of two layers, the first layer being an organosol i.e. an epoxy vinyl or phenolic vinyl organosol, and the second upper layer a vinylcopolymeride.

When manufacturing closures which are suitable for pasteurizing and sterilizing processes, the fact that this two-layer lacquer exhibits good sealing properties in combination with hot sealing lacquers, usually vinylcopolymers, in a further advantage in that a tear-back membrane made of lacquered aluminum thin strip coated with a hot sealing lacquer, i.e. a vinylcopolymeride layer, can be sealed onto the turned over edge of a lid ring which has the above mentioned two-layer lacquer coating.

An embodiment which is able to withstand sterilization particularly well is obtained if the lacquer on the thin strip comprises a first layer in the form of an organosol and on top of this a second layer in the form of a vinylcopolymeride. This embodiment is also particularly suitable as a food can closure which is able to withstand pasteurizing and sterilizing treatments.

BRIEF DESCRIPTION OF THE DRAWINGS

The process of the present invention will now be described in greater detail with the help of schematic drawings wherein FIGS. 1*a* through 1*b:* Illustrate the steps involved in the process for manufacturing rings for can lids. The view is in each case a cross-sectional view.

DETAILED DESCRIPTION

Figure 1:
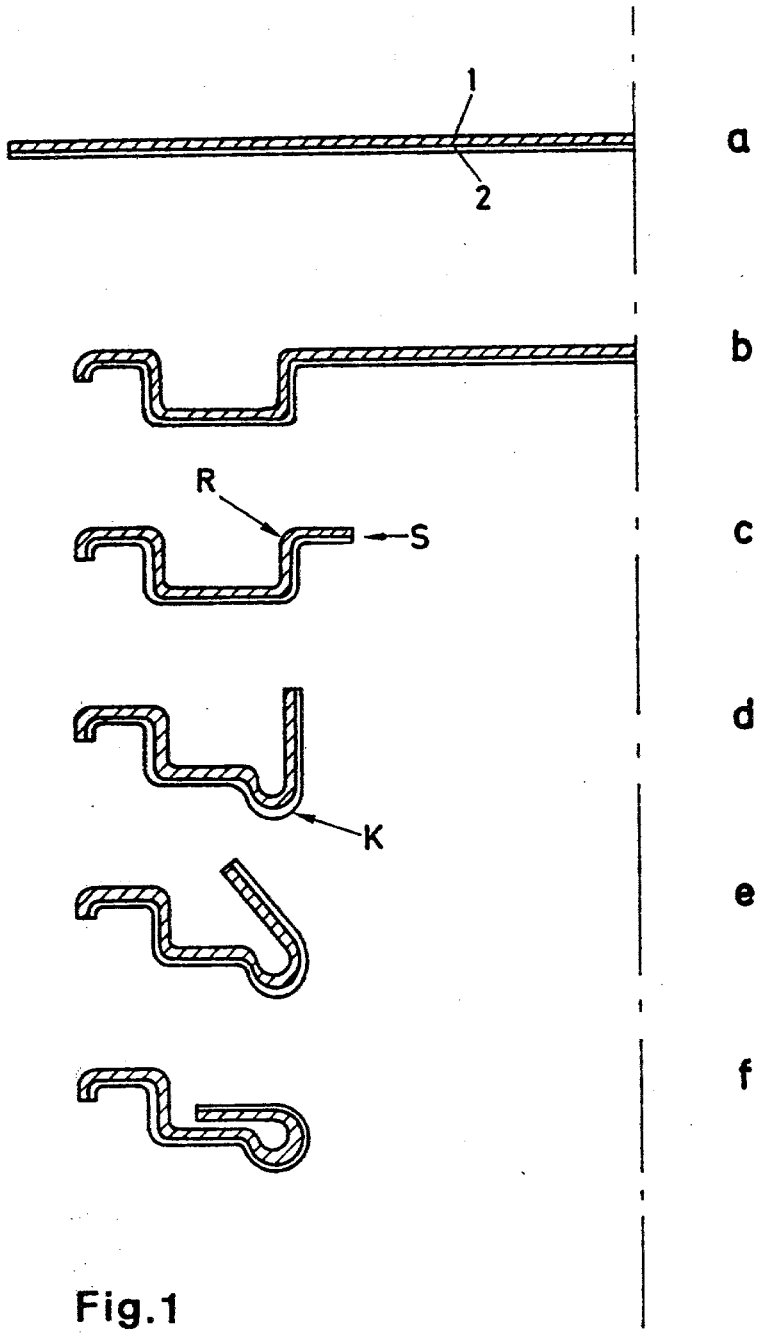

As shown in FIG. 1, a sheet (1) coated on one side with lacquer (2) is pocessed in the following series of steps to create a ring with the cut edge turned over outwards:

(a) Punching out the flat blank as illustrated in FIG. 1*a*.

(b) The blank is then roughly shaped as shown in FIG. 1*b* by means of a first deep drawing process.

(c) The opening is punched out producing the inner cut edge (S) as shown in FIG. 1*c*.

(d) The part (R) next to the cut edge (S) is straightened and the curvature (K) formed by deepening as illustrated in FIG. 1*d*.

(e) The part (R) is bent outwards by stretching as shown in FIG. 1*e*.

(f) The part (R) is pressed flat as illustrated in FIG. 1*f*.

Figure 2:
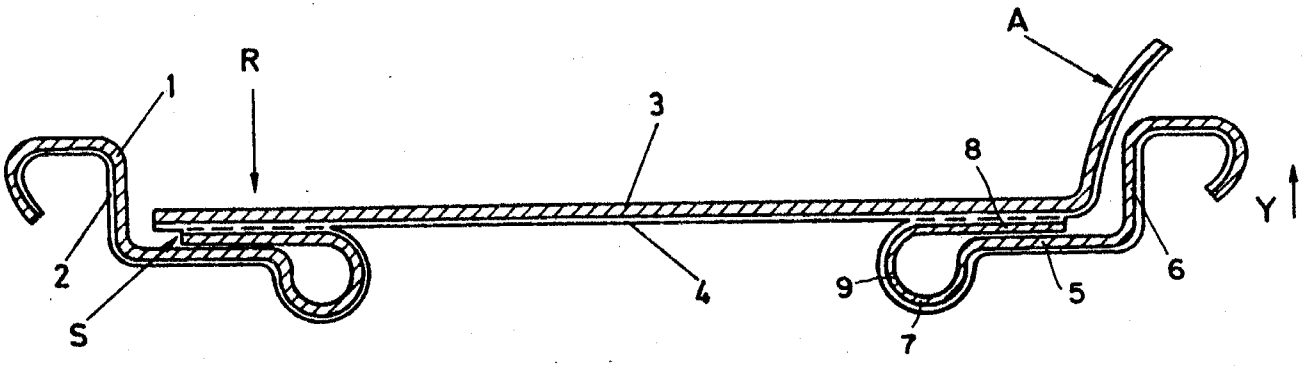
FIG. 2: Is a cross-sectional view of a ring for a can lid with a tear-back membrane sealed onto the ring.

FIG. 2 shows a ring, made in accordance with the process of the present invention from a sheet (1) coated with lacquer (2) on one side, fitted with a lid, with a tear-back tab (A) made of lacquered aluminum thin strip (3) coated with a layer of polyamide (4), sealed onto the said ring.

The ring comprises a horizontal surface 5 having a free end on each end thereof and a vertical surface 6 extending from one of the free ends in a first direction Y from and substantially parallel to the horizontal surface 5. A substantially P-shaped member 7 having a straight leg portion 8 and a curved portion 9 extends from the other end of the horizontal surface 5 such that the straight leg portion 8 lies in the first direction Y and substantially parallel to and over a substantial portion of the horizontal surface 5. The curved portion 9 of the P-shaped member 7 connects the other free end of the horizontal surface 5 with the straight leg portion 8.

The advantages of the process of the present invention can be seen clearly from FIGS. 1 and 2. A ring, which is exceptionally well suited for sealing-on a lid which can be pulled off, can be produced economically. Such a ring, fitted with a pull-off lid is particularly suitable as an easily opened closure for cans of food. With the cut edge turned outwards the problem of corrosion caused by contact with aggressive contents is eliminated and, at the same time, there is no danger of injury to the user.

The advantages of the process of the present invention will now be explained with the help of the following two examples.

EXAMPLE 1

0.24 mm thick aluminum thin strip was coated with an epoxy-vinyl-organosol lacquer and then baked for 10 min at 200° C. The dry weight of the lacquer coating was 6 g/m$^2$. This product was then coated with a vinylcopolymeride containing a white pigment and then dried at 180° C. for 2 min. The dry weight of this coating was 10 g/m$^2$.

Using a conventional transfer press, and the process of the present invention as previously set forth and illustrated in figures 1*a*–1*f*, 73 mm diameter rings for cans were produced from this lacquered aluminum thin strip.

The radius of curvature produced by deep drawing was 0.8 mm.

There were no cracks or tears in the final ring. On testing the lacquer for cracks and pores, it was found that it was still fully intact, even at places which had undergone extreme deformation.

EXAMPLE 2

A 0.22 mm thick sheet of tin-plate was lacquered in the same manner as in Example 1.

Using the same process as in example 1, rings were produced from this lacquered tin-plate. These rings were rectangular in shape, the lengths of the sides being 210 and 130 mm, and the corners had a radius of 35 mm. The radius of curvature produced by deep drawing was 0.8 mm.

There were no cracks in the finished ring. On testing the lacquer for cracks and pores, it was found that the lacquer had not been damaged anywhere on the ring.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A closure for a container comprising in combination a ring having an opening and a can lid for sealing said opening wherein said ring has a first and a second surface, a vertical wall extending in a first direction from said first surface and a cut out edge portion defining said opening which is bent over in said first direction away from said opening so that said first surface of said ring is substantially parallel and proximate to the first surface of said bent over edge portion, wherein said lid comprises a thin aluminum strip having a lacquered surface which seals on the second surface of said bent over portion so as to close said opening.

2. A closure according to claim 1 wherein said second surface of said bent over edge portion has a lacquer coating.

3. A closure according to claim 2 wherein said lacquered surface of said lid comprises a polyamide 12.

4. A closure according to claim 3 wherein said lacquered surface comprises a first layer of phenolic-epoxy resin which is coated with said polyamide 12.

5. A closure according to claim 2 wherein said lacquered surface of said lid comprises a layer of hot sealing lacquer comprising essentially of vinylcopolymers which is sealed to said bent over portion.

6. A closure according to claim 5 wherein said lacquered surface comprises a first layer of an organosol which is coated with said vinylcopolymers.

7. A closure according to claim 1 wherein said closure is able to withstand pasteurizing and sterilizing treatments.

8. A ring for can lids having a first surface and a second surface which comprises a peripheral vertical edge portion extending in a first direction and a bent cut edge portion bent in said first direction, said bent cut edge portion defining an opening, wherein the first surface of said bent cut edge portion is substantially parallel and lies over a substantial portion of said first surface of said ring.

9. A ring according to claim 8 wherein said bent edge portion has a radius of curvature of from about 0.6 mm to 1.0 mm.

10. A ring according to claim 8 wherein said bent edge portion has a radius of curvature of about 0.8 mm.

11. A ring according to claim 8 wherein said first surface is lacquer coated.

12. A ring for can lids comprising a horizontal surface having a free end on each end thereof, a vertical surface extending from one free end in a first direction from and substantially perpendicular to said horizontal surface, a substantially P-shaped member having a straight leg portion and a curved portion extending from said other free end such that said straight leg portion lies in said first direction and is substantially parallel to and lies over a substantial portion of said horizontal surface wherein said curved portion connects said other free end and said straight leg portion.

13. A ring according to claim 12 wherein said radius of curvature of said curved portion is from about 0.6 mm to 1.0 mm.

14. A ring according to claim 12 wherein said radius of curvature of said curved portion is from about 0.8 mm.

* * * * *